United States Patent [19]

Nakajima

[11] 4,317,717

[45] Mar. 2, 1982

[54] NONMAGNETIC CONDUCTIVE MATERIAL SEPARATING APPARATUS

[75] Inventor: Takato Nakajima, Sakaki, Japan

[73] Assignee: Kanetsu Kogyo Kabushiki Kaisha, Ueda, Japan

[21] Appl. No.: 209,310

[22] Filed: Nov. 24, 1980

[30] Foreign Application Priority Data

Dec. 12, 1979 [JP] Japan ..... 55-170981[U]
Dec. 12, 1979 [JP] Japan ..... 55-170982[U]

[51] Int. Cl.[3] ..... B03C 1/12

[52] U.S. Cl. ..... 209/212; 209/221; 209/225; 209/231

[58] Field of Search ..... 209/225, 231, 3, 482, 209/478, 212, 214, 221, 224, 228, 216, 230

[56] References Cited

U.S. PATENT DOCUMENTS 4,194,633 3/1980 Patterson et al. ..... 209/152
4,230,560 10/1980 Nakajima ..... 209/221 X

*Primary Examiner*—Ralph J. Hill

*Attorney, Agent, or Firm*—Stephen F. K. Yee

[57] ABSTRACT

An apparatus for separating a nonmagnetic conductive material from a nonmagnetic nonconductive material. The separation apparatus comprises a drum arranged in a tilted fashion and rotating in one direction about the longitudinal central axis and a chute for throwing a material being separated into the drum from the upper opening thereof. The material supplied through the chute into the drum is agitated by rotation of the drum, and the nonmagnetic conductive material of the material thus supplied into the drum receives an electromagnetic force produced by a magnetic field moving in a direction opposite to the direction of rotation of the drum, so as to be separated from the nonmagnetic nonconductive material. In order to increase the agitation effect for the material supplied into the drum, the chute is biased from the center of the upper opening of the drum to one side of the center depending on the rotational direction of the drum, and shoulder portions are provided on the inner peripheral wall of the drum.

8 Claims, 3 Drawing Figures

NONMAGNETIC CONDUCTIVE MATERIAL SEPARATING APPARATUS

BACKGROUND OF THE INVENTION

1. Field of the Invention

This invention relates to a nonmagnetic conductive material separating apparatus preferably adapted for separating a nonmagnetic conductive material represented by aluminum cans from a mixture material collected as waste.

2. Description of the Prior Art

A mixture material collected as waste, generally speaking, is supplied into a magnetic sorter, so that a magnetic material represented by iron pieces is removed from the mixture material. The mixture material from which the magnetic material has been removed by the magnetic sorter is largely classified into a nonmagnetic nonconductive material represented by wood pieces and waste paper, and a nonmagnetic conductive material represented by aluminum cans. To the effect that the former is separated from the latter, the mixture material is supplied into the nonmagnetic conductive material separating apparatus.

The inventor of the present invention has proposed a separating apparatus in U.S. Application Ser. No. 59,648, now U.S. Pat. No. 4,230,560. The separating apparatus includes a drum rotating in one direction about the longitudinal central axis inclined with respect to the horizontal plane and having an equal inner diameter throughout the length thereof; a chute through which a mixture material to be separated is thrown into the drum from the upper opening thereof; and a means for generating a shifting magnetic field for exerting an electromagnetic force opposite to a rotating direction of the drum on the conductive material contained within the mixture material moving toward the lower opening of the drum.

In the separating apparatus, the mixture material thrown from the upper opening of the drum through the chute into the drum is forced upward along the inner peripheral wall of the drum in the direction of rotation of the drum due to friction relative to the inner peripheral surface of the rotating drum, and then slid down therefrom due to its own weight. The mixture material is moved up and down in the drum in a meandering fashion in the state of being deviated toward the direction of rotation along the bottom wall of the drum toward the lower opening. During the above-described movement, the mixture material passes a magnetic field zone produced by the magnetic field generating means. In the magnetic field zone, the conductive material receives the electromagnetic action, so as to be separated from the nonconductive material. In order to increase the separation efficiency by the action of the electromagnetic force, it is desirable that the conductive material and the nonconductive material which are interwined with each other be loosened before the mixture material arrives at the magnetic field zone.

In the prior art separating apparatus described above, the conductive material twined about or held on the nonconductive material, such as waste paper has been partially loosened, and hence, both are likely to move through the drum integrally, resulting in poor separation efficiency.

SUMMARY OF THE INVENTION

It is accordingly an object of the present invention to provide a nonmagnetic conductive material separating apparatus, which is capable of separating the nonmagnetic conductive material from the nonmagnetic nonconductive material with a high separation efficiency.

It is another object of the present invention to provide a nonmagnetic conductive material separating apparatus, wherein the separation efficiency is greatly increased, without increasing the size of the apparatus.

To attain the above-described objects, there is provided according to the present invention a separating apparatus which comprises a means for increasing an agitation effect for a mixture material supplied in the drum, so that the mixture material entangled in the form of lump can be loosened by the means, with the result of the improved separation efficiency.

In a first embodiment of the invention, the unidirectionally rotating drum is provided with a shoulder portion on the inner peripheral surface thereof, as the agitation effect increasing means, so that the movement of the mixture material from the upper opening of the drum toward the lower opening thereof is subjected to change by the shoulder portion, thereby loosening the nonmagnetic conductive material and the nonmagnetic conductive material, which are intertwined with each other, thereby increasing the separation efficiency by the electromagnetic force produced by the shifting magnetic field generating means.

In a second embodiment of the invention, as means for increasing the agitation effect, a means for throwing a mixture material from the upper opening of a unidirectionally rotating drum into the drum is biased from the vertical plane including the axis of rotation of the drum to one side of said vertical plane depending on the direction of rotation of the drum. A dropping point in the drum, of the mixture material which is supplied into the drum by the mixture-material supply means is deviated from the vertical plane to either right or left side of said vertical plane as view from the lower opening of the drum depending on the direction of rotation of the drum, so that a distance from the dropping point in the drum, of the mixture material to a point, at which the mixture material forced up along the inner peripheral wall of the drum is first dropped due to its own weight, can be increased. Thus, the distance of the meandering movement of the mixture material is increased without increasing the length of the drum or the inner diameter thereof, with the result that the agitation effect by the rotating drum as well as the separation effect by the electromagnetic force of the magnetic field generating means are increased.

DESCRIPTION OF THE PREFERRED EMBODIMENTS

Figure 1:
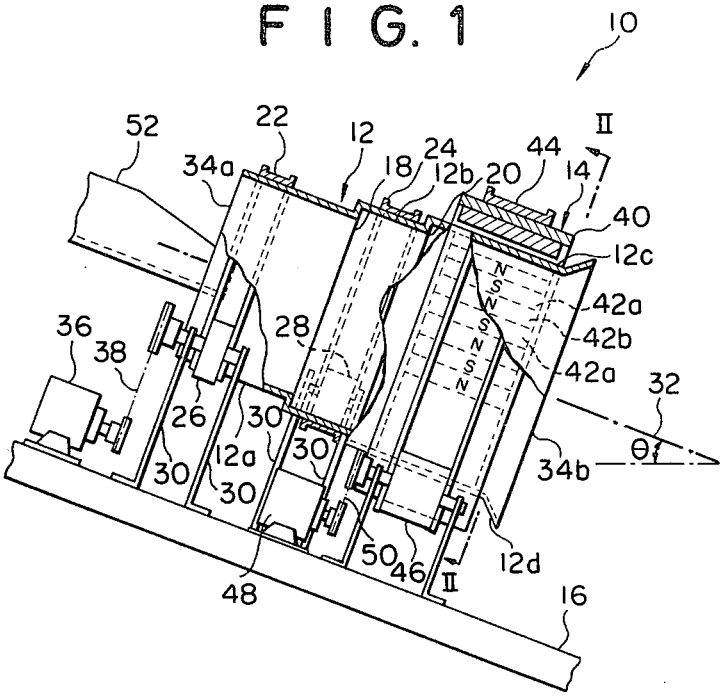
FIG. 1 is a front view, partly broken away, of a nonmagnetic conductive material separating apparatus according to the present invention.

A separating apparatus 10 according to the present invention comprises: a drum 12 open at opposite ends and made of a nonmagnetic material; a means 14 for generating a shifting magnetic field; and a frame 16 inclined with respect to the horizontal plane.

The drum 12 includes a diametrically small portion 12*a*, a diametrically intermediate portion 12*b* adjoining to the diametrically small portion 12*a*, and a diametrically large portion 12*c* adjoining to the diametrically intermediate portion, whereby circumferentially extending shoulder portions 18 and 20 are formed along the inner peripheral walls between the diametrically small portion 12*a* and the diametrically intermediate portion 12*b*, and between the diametrically intermediate portion 12*b* and the diametrically large portion 12*c*, respectively. Annular guide members 22 and 24 are provided on the outer peripheral surfaces of the small diameter portion 12*a* and the intermediate diameter portion 12*b*, respectively, and the open end of the large diameter portion 12*c* is divergent in the longitudinal direction of the drum, thereby forming a divergent edge 12*d*.

A pair of drive rollers 26 and a pair of driven rollers 28 are rotatably mounted on brackets 30, which in turn are supported on the frame 16, these drive rollers and driven rollers being fitted into the annular guide members 22 and 24 on the drum 12 (only one drive roller and only one driven roller are shown in FIG. 1). The drum 12 is placed on the drive rollers and driven rollers maintained in engagement with the annular guide members 22 and 24, respectively. The drum 12 is thus supported above the frame 16 in a tilted fashion, with the longitudinal central axis 32 thereof making an angle $\theta$ with respect to the horizontal plane, and the opening 34*a* of the diametrically small portion 12*a* being located at a higher level than the opening 34*b* of the diametrically large portion 12*c*. The rotational force of a drive motor 36 provided on the frame is transmitted by way of a chain 38 to the drive rollers 26, whereby the drum 12 is rotated clockwise about the central axis 32 thereof, as viewed from the lower opening 34*b* of the drum 12 in FIG. 2.

Figure 2:
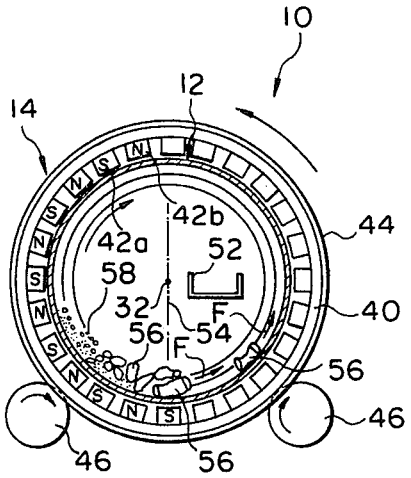
FIG. 2 is a transverse cross sectional view taken along the line II—II of FIG. 1.

The shifting magnetic field generating means 14, in the embodiment shown in FIGS. 1 and 2, includes an annular member 40 surrounding the diametrically large portion 12*c* of the drum coaxially therewith, and a plurality of permanent magnets 42*a* and 42*b* embedded in the inner peripheral wall of the annular member. The permanent magnets 42*a* and 42*b* are so arranged that, in the magnetic pole faces opposing the outer periphery of the diametrically large portion 12*c*, one magnetic poles alternate with the other magnetic poles in the circumferential direction of the annular member, as best seen in FIG. 2. The boundaries between adjacent magnetic poles of respective permanent magnets 42*a* and 42*b* extend in parallel to the central axis 32 of the drum 12, as shown in FIG. 1. An annular guide member 44 is provided on the outer peripheral surface of the annular member 40. The annular member 40 is placed on a pair of drive rollers 46 supported on the frame 16 and maintained in engagement with the annular guide member 44. The rotational force of drive motor 48 supported on the frame 16 is transmitted via a chain 50 to the drive rollers 46, whereby the annular member 40 can be rotated about the central axis 32 in a reverse direction to the direction of rotation of the drum 12, namely, counterclockwise in FIG. 2.

Rotation of the annular member 40 causes the magnetic field generated by the permanent magnets 42*a* and 42*b* embedded in the inner peripheral wall of the annular member to rotate opposite to the direction of rotation of the drum, around the diametrically large portion 12*c* of the drum 12. The rotating magnetic field induces an eddy current on the nonmagnetic conductive material moving along the bottom wall of the diametrically large portion 12*c* of the drum 12 toward the lower opening 34*b* thereof, thereby exerting on the nonmagnetic conductive material an electromagnetic force F along the direction of rotation of the rotating magnetic field, namely, opposite to the direction of rotation of the drum. The electromagnetic force F is proportional to the speed of rotation of the rotating magnetic field. If the speed of the annular member 40 rotating independently of the drum 12 is increased, the electromagnetic force F is intensified without causing a strong centrifugal force to act on the mixture material supplied into the drum 12.

The electromagnetic force F consists of only transverse components parallel to the direction of rotation of the rotating magnetic field, in the case where the boundary lines between adjacent magnetic poles are substantially in parallel to the rotational axis 32 of the drum, as shown in FIG. 1. Where the boundaries between the adjacent magnetic poles are substantially inclined with respect to the rotational axis 32 of the drum 12 in a manner to be twisted along the rotational axis of the drum, the vertical components toward the lower opening 34*b* are contained in the electromagnetic force F. A linear motor which covers the lower part of the diametrically large portion 12*c* may be employed, as the shifting-magnetic-field generating means 14.

A chute 52 is inserted into the upper opening 34*a* of the drum 12 as a means for throwing the mixture material being separated into the drum 12. The chute 52, as is obvious from FIG. 2, is biased from the vertical plane 54 which includes the rotational axis of the drum to one side of the vertical plane 54 depending on the direction of rotation of the drum 12, namely, in the right half part of the upper opening 34*a* of the drum 12 rotating in the right-handed direction, as viewed from the lower opening 34*b* of the drum, in the embodiment of FIG. 2. In case the drum 12 is rotated counterclockwise, as viewed from the lower opening side 34*b* of the drum, then the chute 52 should be located in the left half part of the upper opening 34*a*, as viewed from the lower opening 34*b* of the drum.

The mixture material from which the magnetic material represented by iron pieces has been removed beforehand is supplied through the chute 52 into the drum 12, as described above. The mixture material being thrown into the drum is largely classified into the nonmagnetic conductive material 56 represented by aluminum cans and the nonmagnetic nonconductive material 58 represented by waste paper or wood pieces. The mixture material is continuously dropped from the chute 52 into the drum 12, so that the mixture material can be separated into the nonmagnetic conductive material and the nonmagnetic nonconductive material.

Figure 3:
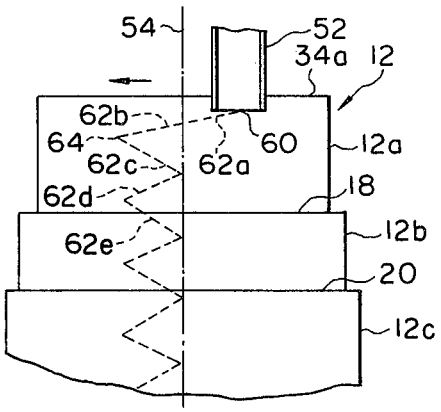
FIG. 3 is a developed view of a drum, showing the course of movement of the mixture material in the drum shown in FIG. 1.

FIG. 3 is a developed view of the drum 12, wherein the course of movement of the mixture material dropped from the chute 52 into the drum 12 is diagrammatically shown by a broken line. The mixture material dropped to a point 60 on the bottom of the diametrically small portion 12*a* of the drum 12 is moved from the point 60 toward the vertical plane 54 along a line 62*a* by rotation of the drum 12 as well as by its own weight, and thence, moved in a direction opposite to the point 60 to be put upward along the inner peripheral surface of the drum along a line 62*b* due to friction relative to the inner peripheral wall of the drum 12. When the mixture material reaches a point 64 at which the weight of the mixture material itself exceeds the frictional force relative to the inner peripheral surface of the drum 12, the mixture material is in turn moved toward the vertical plane 54 as shown by a line 62*c*, and then moved along the bottom wall of the drum 12 in a meandering fashion along lines 62*d*, *e* . . . due to its own weight within the range of angle formed by the vertical plane 54 and the point 64, through the diametrically small portion 12*a*, the diametrically intermediate portion 12*b* and the diametrically large portion 12*c*, eventually to the lower opening 34*b* of the large diameter portion.

Due to the fact that the conductive material 56 of the mixture material has a configuration liable to roll, such as aluminum cans, has a larger size and higher specific gravity than those of the nonconductive material 58, and has a smaller coefficient of friction than that of the nonconductive material, the conductive material 56 tends to be biased toward the vertical plane 54, as compared with the nonconductive material 58, during the meandering movement of the mixture material which starts from the dropping point 60 in the drum. For these reasons, the chute 52 is located in the right part portion of the drum, which is biased from the vertical plane 54, as described, so that the mixture material can be dropped to the point 60 remote from the vertical plane 54, thereby increasing by a distance equivalent to the length of the line 62*a* the distance of movement of the mixture material which leads from the dropping point to the magnetic field zone, as compared with that in the prior art device. Consequently, the density of the conductive material in the mixture material greatly increases on the side nearer to the vertical plane 54 during the meandering movement of the mixture material to the magnetic field zone.

The mixture material passes through the shoulder portions 18 and 20 during the meandering movement thereof in the drum. In the shoulder portions 18 and 20, the mixture material moving in the form of lump is inverted and/or receives a different circumferential speed accruing from a difference in inner diameter between the diametrically small portions and the diametrically intermediate portion, and hence the movement of the mixture material is subjected to change at each shoulder portion 18,20. Consequently, the conductive material 56 put on or twined about waste paper is released from the nonconductive material 58 such as waste paper and comes to the magnetic field zone in the diametrically large portion 12*c* of the drum.

In the magnetic field zone, the conductive material 56 receives the electromagnetic force F acting in an opposite direction to the rotational direction of the drum 12, as described above, and the nonconductive material 58 by no means receives such an electromagnetic force.

The nonconductive material 58 is therefore carried toward the lower opening of the drum in the state of being deviated towards the rotational direction of the drum, namely, to the left side from the vertical plane 54, as viewed in FIG. 2, and discharged from the lower opening 34*b* of the drum 12.

In contrast thereto, the conductive material 56 is directed opposite to the rotational direction of the drum 12 by the action of the electromagnetic force F. In the magnetic field zone, the density of the conductive material 56 in the mixture material is large on the side near to the vertical plane 54, and the conductive material twined about the nonconductive material becomes loosened. The electromagnetic force F is thus permitted to effectively act on the conductive material 56 as a force of separating same from the nonconductive material 58, whereby the conductive material can be positively directed opposite to the rotational direction of the drum 12. The conductive material 56 is discharged from the right side of the lower opening 34*b*, being biased from the vertical plane 54, as viewed in FIG. 2, and successively recovered separately from the nonconductive material.

The chute 52 may be replaced by an oscillation feeder or a belt conveyor, as long as the mixture material supply opening is biased to one side of said vertical plane depending on the direction of rotation of the drum 12.

In the embodiment described, two circumferential shoulder portions 18 and 20 are provided along the inner peripheral walls between diametrically different portions. The number of the shoulder portions may be decreased to one or increased to more than three, as the case may be. In place of the circumferential shoulder portions, shoulder portions extending lengthwise of the drum may be provided along the inner peripheral wall of the drum equal in diameter throughout the length thereof.

The separating apparatus 10 may incorporate a magnetic sorter so as to thoroughly remove from the mixture material the conductive material residual therein.

Although in the embodiment of FIGS. 1 and 2, two shoulder portions 18 and 20 are provided in the drum, and the mixture-material supply means 52 is biased from the center of the drum, either of these methods may be used individually, to provide the shoulder portions and to locate the mixture supply means in a portion biased from the center of the drum.

According to the present invention, by the shoulder portion provided along the inner peripheral wall of the drum, the movement of the mixture material is subjected to change when passing the shoulder portion, whereby the nonmagnetic conductive material held on or twined about the nonconductive material during the travel in the drum is released from the nonmagnetic nonconductive material or becomes loosened before the mixture material reaches the moving magnetic field zone. Consequently, the electromagnetic force produced by the shifting magnetic field is caused to effectively act on the conductive material as a force of separating the conductive material from the nonconductive material, thereby preventing the conductive material from being carried away by the nonconductive material as the former is twined about the latter, thus improving the separation efficiency.

According to the present invention, the means for supplying a mixture material being separated into a drum disposed in a tilted fashion is provided, with the mixture supply opening thereof biased from the vertical plane including the rotational axis of the drum to one side of the vertical plane depending on the rotational direction of the drum, thereby increasing a distance for meandering stroke of the mixture material leading from the dropping point in the drum to the shifting magnetic field zone therein, without increasing a diameter and a length of the drum, whereby the agitation effect for the mixture material by the contact of the mixture material with the inner peripheral wall of the drum is increased. As a result, the electromagnetic force generated by the shifting magnetic field is permitted to effectively act on the conductive material as a separation force, without increasing the size of the separation apparatus itself, and with increased separation efficiency.

What is claimed is:

1. A nonmagnetic conductive material separating apparatus comprising:

a drum disposed in a tilted fashion and rotating in one direction about the longitudinal central axis thereof, said drum being formed of a nonmagnetic material;

a means for supplying a mixture material to be separated into said drum from the upper opening of said drum;

a means for producing a shifting magnetic field for exerting an electromagnetic force reverse to a direction of rotation of said drum on a nonmagnetic conductive material contained in the mixture material moving in the drum toward the lower opening of said drum, while being agitated by rotation of said drum; and a shoulder portion extending along the inner peripheral wall of said drum for increasing the agitation efficiency for said mixture material moving in said drum, said shoulder portion changing the movement of the mixture material through said drum.

2. A nonmagnetic conductive material separating apparatus as defined in claim 1, wherein said shoulder portion extends in the circumferential direction of said drum.

3. A nonmagnetic conductive material separating apparatus as defined in claim 2, wherein said drum consists of a diametrically small portion having an open end which is the upper opening of said drum, a diametrically intermediate portion adjoining said diametrically small portion, thereby defining a first shoulder portion therebetween, and a diametrically large portion adjoining said diametrically intermediate portion, thereby defining a second shoulder portion therebetween, and said diametrically large portion having an open end which is the lower opening of said drum.

4. A nonmagnetic conductive material separating apparatus as defined in claim 3, wherein said shifting-magnetic-field generating means includes an annular member surrounding the diametrically large portion of said drum coaxially therewith and rotating in a direction reverse to the direction of rotation of said drum, and a plurality of permanent magnets embedded in the inner peripheral wall of said annular member, with the different magnetic poles alternating with each other in the circumferential direction of the annular member.

5. A nonmagnetic conductive material separating apparatus as defined in claim 1, wherein said mixture supply means is biased to one side of a vertical plane which includes the central axis of said drum, depending on the direction of rotation of said drum.

6. A nonmagnetic conductive material separating apparatus as defined in claim 5, wherein said mixture supply means is located to the right of said vertical plane as viewed from the lower opening of said drum when said drum is rotated clockwise.

7. A nonmagnetic conductive material separating apparatus as defined in claim 5, wherein said mixture supply means is located to the left of said vertical plane as viewed from the lower opening of said drum when said drum is rotated counterclockwise.

8. A nonmagnetic conductive material separating apparatus as defined in claim 5, wherein said mixture-material supply means is a chute.

* * * * *

UNITED STATES PATENT AND TRADEMARK OFFICE

CERTIFICATE OF CORRECTION

PATENT NO. : 4,317,717

DATED : March 2, 1982

INVENTOR(S) : Takato Nakajima

It is certified that error appears in the above-identified patent and that said Letters Patent is hereby corrected as shown below:

Column 2, line 27, "conductive" should read --nonconductive--.

Signed and Sealed this

*Twenty-fourth* Day of *August 1982*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,317,717

DATED : March 2, 1982

INVENTOR(S) : TAKATO NAKAJIMA

It is certified that error appears in the above-identified patent and that said Letters Patent are hereby corrected as shown below:

Column 6, line 33, "used individually, to provide the shoulder portions and" should read --used individually.--

Column 6, lines 34 and 35 should be deleted.

Column 6, lines 47-48, "of separating" should read --to separate--.

Signed and Sealed this

Seventh Day of December 1982

[SEAL]

Attest:

GERALD J. MOSSINGHOFF

Attesting Officer

Commissioner of Patents and Trademarks